US005967875A

United States Patent [19]

Graef

[11] Patent Number: 5,967,875

[45] Date of Patent: Oct. 19, 1999

[54] MEGAPHONE CUP

[76] Inventor: Mark A. Graef, 1032 E. 400 South #601B, Salt Lake City, Utah 84102

[21] Appl. No.: 09/022,356

[22] Filed: Feb. 12, 1998

[51] Int. Cl.[6] ..... A63H 33/00; B65D 6/16

[52] U.S. Cl. ..... 446/74; 446/71; 181/178; 220/8; 220/625

[58] Field of Search ..... 446/71, 77, 74; 181/178–180; 62/457.3; 220/8, 625

[56] References Cited

U.S. PATENT DOCUMENTS

| | | | |
|---|---|---|---|
| 1,270,462 | 6/1918 | Thueringer | 220/8 |
| 2,299,182 | 10/1942 | Schoof | 220/8 |
| 2,790,504 | 4/1957 | Hooe | 181/178 |
| 3,471,058 | 10/1969 | Latham et al. | 220/8 |
| 4,538,653 | 9/1985 | Shea et al. | 141/285 |
| 4,618,066 | 10/1986 | Vail | 215/12 R |
| 4,627,334 | 12/1986 | Shanklin | 220/8 |
| 4,703,829 | 11/1987 | Hardt | 181/178 |
| 5,501,363 | 3/1996 | Muller et al. | 220/630 |

*Primary Examiner*—Robert A. Hafer
*Assistant Examiner*—Laura Fossum

[57] ABSTRACT

A new megaphone cup for providing a device that is convertible between a drinking cup and a megaphone. The inventive device includes a base having upper and lower surfaces with a tubular cup mount upwardly extending from the upper surface of the base. The cup mount has a lumen and an upper opening into the lumen. Removably inserted into the lumen is the bottom end of a cup member. The top and bottom ends of the cup member both have openings into the cup member hollow interior and the cup member is also tapered towards the bottom end of the cup member. When the cup member is detached from the cup mount, a user may shout into the opening of the bottom end to use the cup member as a megaphone. The cup member also includes an extendable portion which is retractably extendable between an extended position and a retracted position.

14 Claims, 4 Drawing Sheets

MEGAPHONE CUP

BACKGROUND OF THE INVENTION

1. Field of the Invention

The present invention relates to megaphone cups and more particularly pertains to a new megaphone cup for providing a device that is convertible between a drinking cup and a megaphone.

2. Description of the Prior Art

The use of megaphone cups is known in the prior art. More specifically, megaphone cups heretofore devised and utilized are known to consist basically of familiar, expected and obvious structural configurations, notwithstanding the myriad of designs encompassed by the crowded prior art which have been developed for the fulfillment of countless objectives and requirements.

Known prior art megaphone cups include U.S. Pat. No. 4,125,218; U.S. Pat. No. 4,618,066; U.S. Pat. No. Des. 333,409; U.S. Pat. No. 4,703,829; U.S. Pat. No. 5,160,815; and U.S. Pat. No. 4,402,195.

While these devices fulfill their respective, particular objectives and requirements, the aforementioned patents do not disclose a new megaphone cup. The inventive device includes a base having upper and lower surfaces with a tubular cup mount upwardly extending from the upper surface of the base. The cup mount has a lumen and an upper opening into the lumen. Removably inserted into the lumen is the bottom end of a cup member. The top and bottom ends of the cup member both have openings into the cup member hollow interior and the cup member is also tapered towards the bottom end of the cup member. When the cup member is detached from the cup mount, a user may shout into the opening of the bottom end to use the cup member as a megaphone. The cup member also includes an extendable portion which is retractably extendable between an extended position and a retracted position.

In these respects, the megaphone cup according to the present invention substantially departs from the conventional concepts and designs of the prior art, and in so doing provides an apparatus primarily developed for the purpose of providing a device that is convertible between a drinking cup and a megaphone.

SUMMARY OF THE INVENTION

In view of the foregoing disadvantages inherent in the known types of megaphone cups now present in the prior art, the present invention provides a new megaphone cup construction wherein the same can be utilized for providing a device that is convertible between a drinking cup and a megaphone.

The general purpose of the present invention, which will be described subsequently in greater detail, is to provide a new megaphone cup apparatus and method which has many of the advantages of the megaphone cups mentioned heretofore and many novel features that result in a new megaphone cup which is not anticipated, rendered obvious, suggested, or even implied by any of the prior art megaphone cups, either alone or in any combination thereof.

To attain this, the present invention generally comprises a base having upper and lower surfaces with a tubular cup mount upwardly extending from the upper surface of the base. The cup mount has a lumen and an upper opening into the lumen. Removably inserted into the lumen is the bottom end of a cup member. The top and bottom ends of the cup member both have openings into the cup member hollow interior and the cup member is also tapered towards the bottom end of the cup member. When the cup member is detached from the cup mount, a user may shout into the opening of the bottom end to use the cup member as a megaphone. The cup member also includes an extendable portion which is retractably extendable between an extended position and a retracted position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new megaphone cup apparatus and method which has many of the advantages of the megaphone cups mentioned heretofore and many novel features that result in a new megaphone cup which is not anticipated, rendered obvious, suggested, or even implied by any of the prior art megaphone cups, either alone or in any combination thereof.

It is another object of the present invention to provide a new megaphone cup which may be easily and efficiently manufactured and marketed.

It is a further object of the present invention to provide a new megaphone cup which is of a durable and reliable construction.

An even further object of the present invention is to provide a new megaphone cup which is susceptible of a low cost of manufacture with regard to both materials and labor, and which accordingly is then susceptible of low prices of sale to the consuming public, thereby making such megaphone cup economically available to the buying public.

Still yet another object of the present invention is to provide a new megaphone cup which provides in the apparatuses and methods of the prior art some of the advantages thereof, while simultaneously overcoming some of the disadvantages normally associated therewith.

Still another object of the present invention is to provide a new megaphone cup for providing a device that is convertible between a drinking cup and a megaphone.

Yet another object of the present invention is to provide a new megaphone cup which includes a base having upper and lower surfaces with a tubular cup mount upwardly extending from the upper surface of the base. The cup mount has a lumen and an upper opening into the lumen. Removably inserted into the lumen is the bottom end of a cup member. The top and bottom ends of the cup member both have openings into the cup member hollow interior and the cup member is also tapered towards the bottom end of the cup member. When the cup member is detached from the cup mount, a user may shout into the opening of the bottom end to use the cup member as a megaphone. The cup member also includes an extendable portion which is retractably extendable between an extended position and a retracted position.

Still yet another object of the present invention is to provide a new megaphone cup that once the beverage is consumed the cup may be converted into a megaphone.

Even still another object of the present invention is to provide a new megaphone cup that permits the display of logos thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
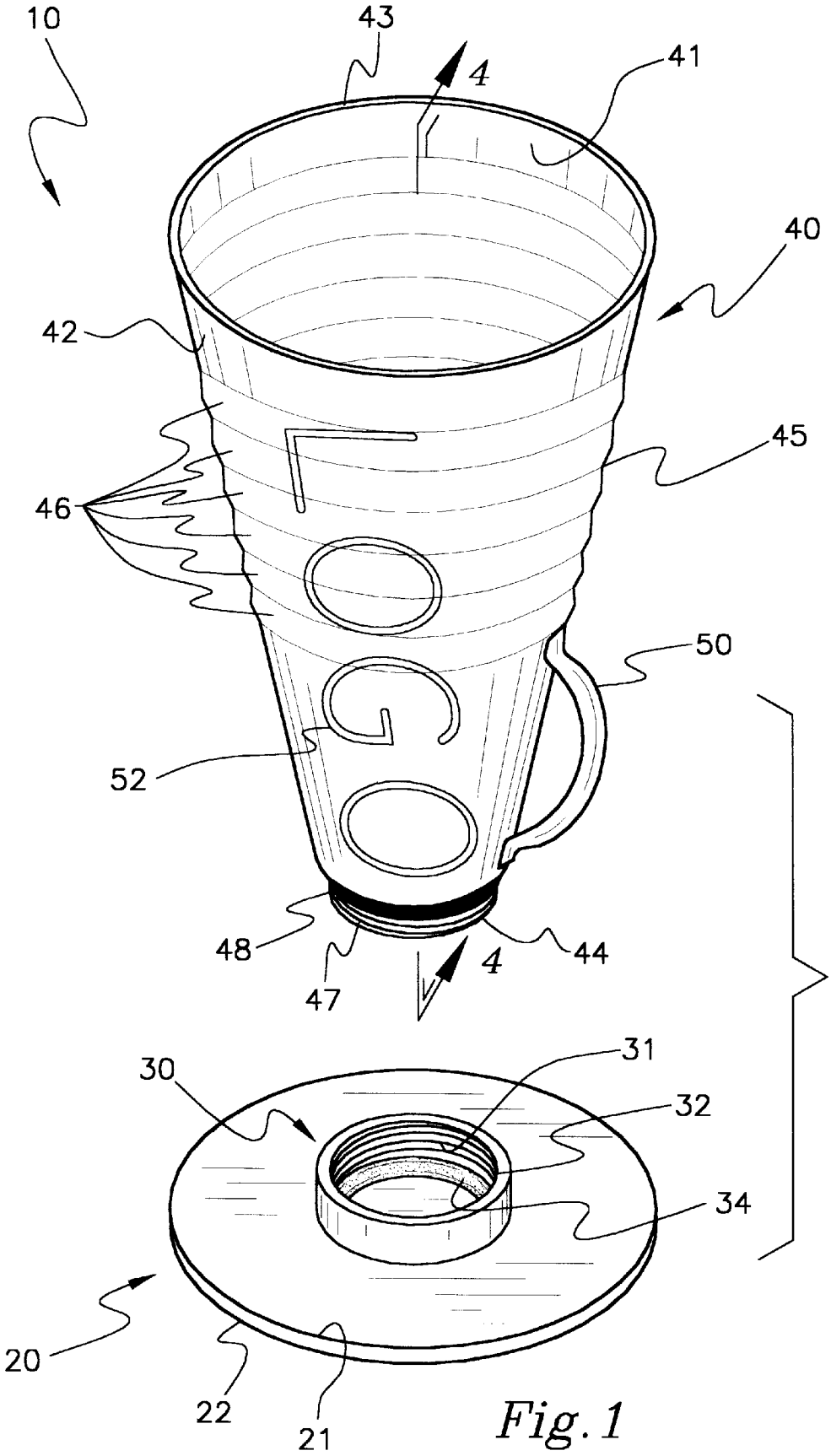
FIG. 1 is a schematic perspective view of a new megaphone cup with the cup member detached from the cup mount according to the present invention.

With reference now to the drawings, and in particular to FIGS. 1 through 4 thereof, a new megaphone cup embodying the principles and concepts of the present invention and generally designated by the reference numeral 10 will be described.

Figure 2:
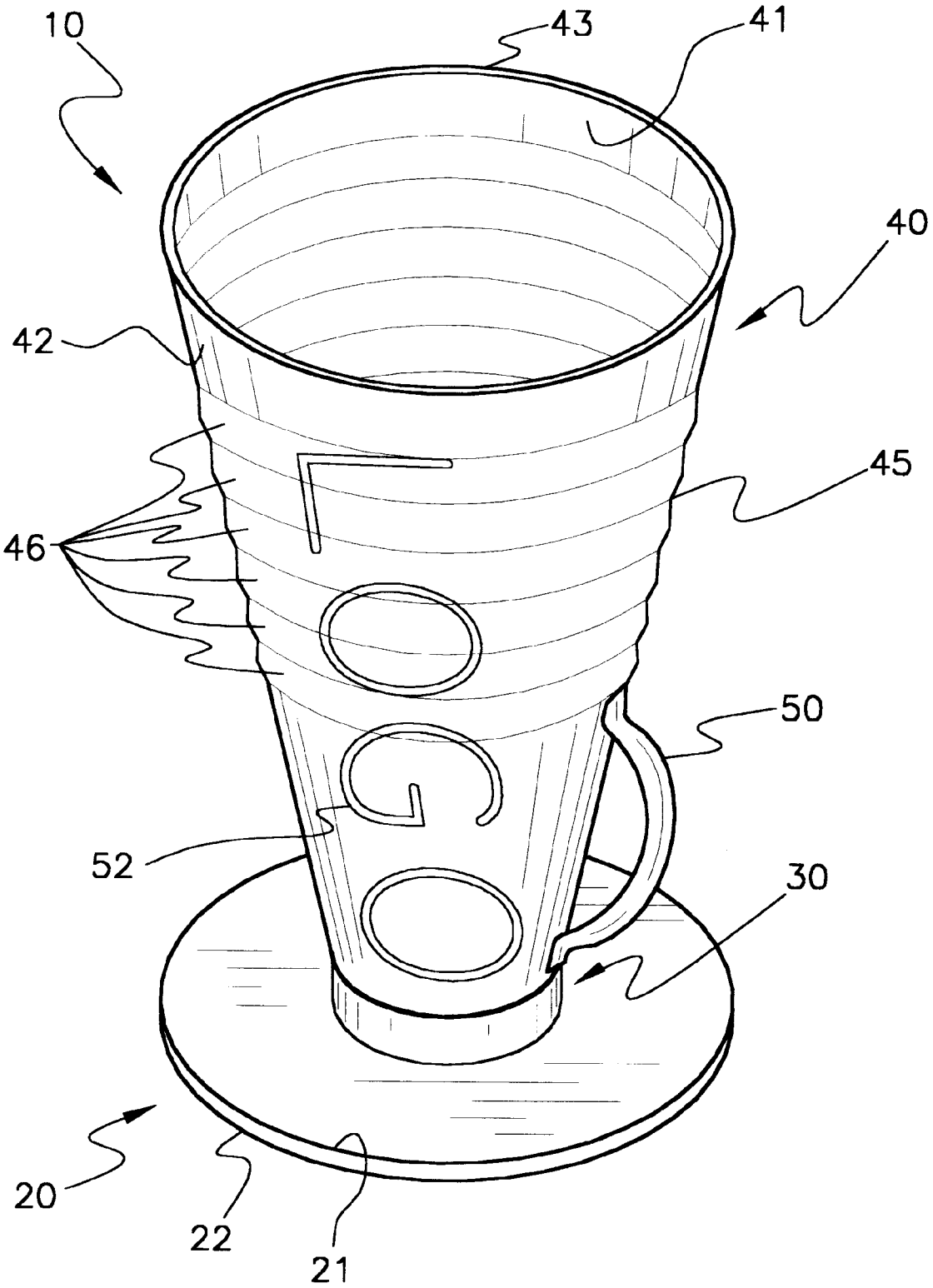
FIG. 2 is a schematic perspective view of the present invention with the cup member attached to the cup mount.
Figure 3:
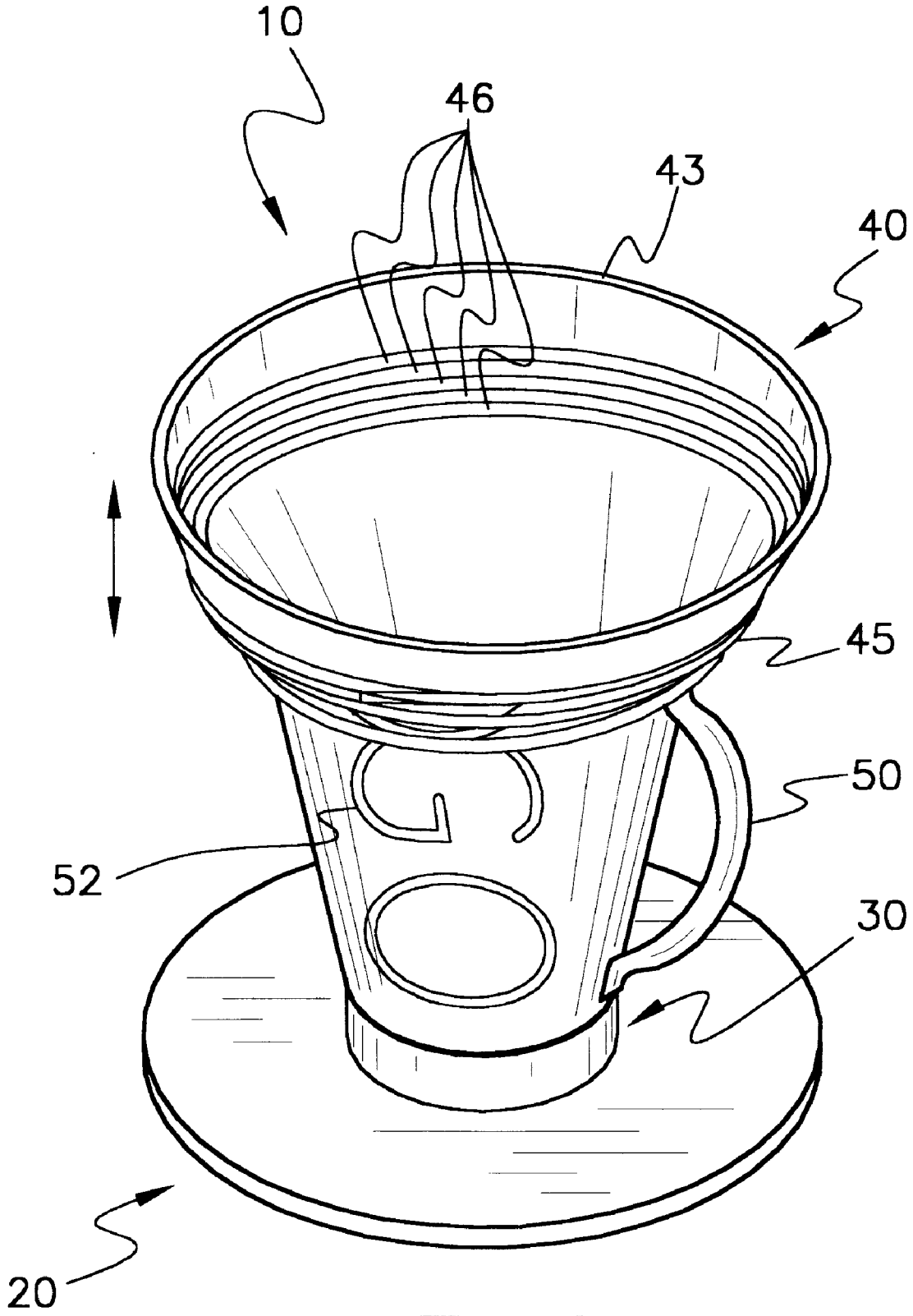
FIG. 3 is a schematic perspective view of the present invention with the cup member attached to the cup mount and the extendable portion of the cup member in the retracted position.

The megaphone cup 10 is device that can be used to hold a beverage and also be converted to be used as a megaphone. As best illustrated in FIGS. 1 through 4, the megaphone cup 10 generally comprises a base 20 having upper and lower surfaces 21, 22 with a tubular cup mount 30 upwardly extending from the upper surface 21 of the base 20. The cup mount 30 has a lumen 31 and an upper opening 32 into the lumen 31. Removably inserted into the lumen 31 is the bottom end 44 of a cup member 40. The top and bottom ends 43,44 of the cup member both have openings into the cup member hollow interior and the cup member 40 is also tapered towards the bottom end 44 of the cup member. When the cup member 40 is detached from the cup mount 30, a user may shout into the opening of the bottom end 44 to use the cup member 40 as a megaphone. The cup member 40 also includes an extendable portion 45 which is retractably extendable between an extended position (as illustrated in FIGS. 1 and 2) and a retracted position (as illustrated in FIG. 3).

Specifically, the base 20 is preferably generally circular and has upper and lower surfaces 21, 22. The lower surface 22 of the base 20 is designed for resting on a surface. The tubular cup mount 30 is generally cylindrical and is upwardly extended from the upper surface 21 of the base 20. The cup mount 30 preferably has a threaded lumen 31 and an upper opening 32 into the lumen 31. Disposed within the lumen, is an annular sealing ring 34. As illustrated in FIG. 1, the sealing ring 34 is preferably extended along on the inner surface of the cup mount 30 and positioned towards the upper surface 21 of the base 20. The sealing ring 34 is designed for helping provide a liquid tight seal between the base 20 and the cup member 40 when the cup member 40 is inserted into the lumen 31 of the cup mount 30. Ideally, the sealing ring 34 is made of rubber.

The cup member 40 is preferably generally frusto-conical tapering towards the bottom end 44 of the cup member 40. The inner surface 41 of the cup member 40 defines the cup member hollow interior. The top end 43 of the cup member 40 has a top opening into the cup member hollow interior while the bottom end 44 of the cup member 40 has a bottom opening into the cup member hollow interior. The bottom opening of the cup member 40 is designed for shouting through for use as a megaphone when the cup member 40 is separated from the cup mount 30. Preferably, the bottom end 44 of the cup member 40 has threads 47 provided on the outer surface 42 of the cup member 40 so that the bottom end 44 is threadably (and removably) inserted through the upper opening 32 of the cup mount 30 into the threaded lumen 31 of the cup mount 30. When the cup member 40 is coupled to the cup mount 30, the sealing ring 34 helps provide a substantially liquid tight seal between the bottom end 44 of the cup member 40 and the inner surface of the cup mount 30.

In the preferred embodiment, the outer surface 42 of the cup member 40 also includes an annular sealing gasket 48 is positioned adjacent the threads 47 of the bottom end 44 of the cup member 40. The sealing gasket 48 is positioned on the cup member 40 so that it is inserted into the lumen 31 when the cup member 40 is inserted into the cup member 30. Like the sealing ring, the sealing gasket helps provide an additional substantially liquid tight seal between the outer surface 42 of the cup member 40 and the inner surface of the cup mount 30. Ideally, the sealing gasket 48 also is made of rubber.

Figure 4:
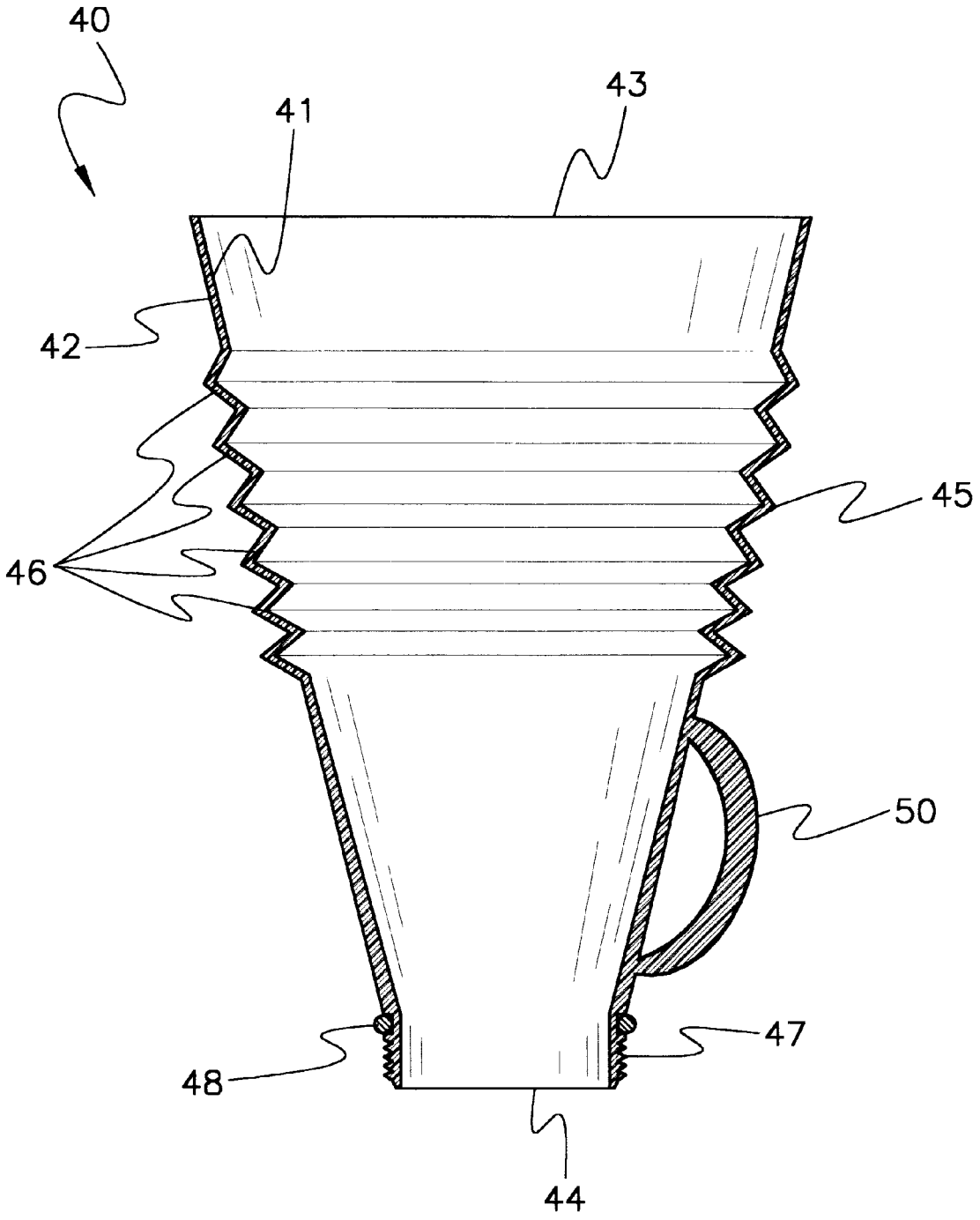
FIG. 4 is a schematic cross-sectional view of the cup member of the present invention.

The extendable portion 45 of the cup member 40 has a plurality of concentric pleats 46 which permit retractable extension of the extendable portion 45 of the cup member between an extended position (which is depicted in FIGS. 1, 2 and 4) and a retracted position (which is depicted FIG. 3). The cup member 40 is usable as a megaphone when the cup member 40 is detached from the cup mount 30 and, preferably, when the extendable portion 45 is in the extended position.

Preferably, a handle 50 is coupled to the outer surface 42 of the cup member 40 and positioned towards the bottom end 44 of the cup member 40. Ideally, an image 52 is displayed on the outer surface 42 of the cup member 40. The image 52 may be of any type and design and include logos and alphanumeric characters.

In use, when the cup member 40 is coupled to the cup mount 30, the invention may be used as a beverage cup. When the cup member 40 is detached from the cup mount 30, the cup member 40 may be used as a megaphone.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A megaphone cup, comprising;

a base having upper and lower surfaces, said lower surface of said base being for resting on a surface;

a tubular cup mount being upwardly extended from said upper surface of said base, said cup mount having a lumen and an upper opening into said lumen of said cup mount;

a cup member having inner and outer surfaces, top and bottom ends, and an extendable portion, said cup member being tapered towards said bottom end of said cup member, said inner surface of said cup member defining a cup member hollow interior;

said top end of said cup member having a top opening into said cup member hollow interior;

said bottom end of said cup member having a bottom opening into said cup member hollow interior, said bottom end of said cup member being removably inserted through said upper opening of said cup mount into said lumen of said cup mount;

said extendable portion of said cup member having a perimeter wall which is continuous from said top opening towards said bottom opening, said perimeter wall of said extendable portion having a plurality of coaxial annular accordion-style pleats;

said pleats permitting retractable extension of said extendable portion of said cup member between an extended position and a retracted position.

2. The megaphone cup of claim 1, wherein said base is generally circular.

3. The megaphone cup of claim 1, wherein said cup mount is generally cylindrical, and wherein said cup member is generally frusto-conical.

4. The megaphone cup of claim 1, wherein said lumen of said cup mount is threaded, wherein said bottom end of said cup member has threads provided on said outer surface of said cup member, said bottom end of said being threadably inserted through said upper opening of said cup mount into said threaded lumen of said cup mount.

5. The megaphone cup of claim 4, wherein said outer surface of said cup member has an annular sealing gasket being positioned adjacent said threads of said bottom end of said cup member, said sealing gasket being inserted into said lumen of said cup mount, said sealing gasket providing a substantially liquid tight seal between said outer surface of said cup member and said cup mount.

6. The megaphone cup of claim 5, wherein said sealing gasket comprises rubber.

7. The megaphone cup of claim 1, further comprising an annular sealing ring being disposed within said lumen of said cup mount, said sealing ring being positioned towards said upper surface of said base, wherein said sealing ring provides a substantially liquid tight seal between said bottom end of said cup member and said cup mount.

8. The megaphone cup of claim 7, wherein said sealing ring comprises rubber.

9. The megaphone cup of claim 1, further comprising a handle being coupled to said outer surface of said cup member, said handle member positioned towards said bottom end of said cup member.

10. The megaphone cup of claim 1, wherein an image is displayed on said outer surface of said cup member.

11. The megaphone cup of claim 1, wherein said extendable portion of said cup member has a first frusto-conical configuration when positioned in said extended position and a second frusto-conical configuration when positioned in said retracted position, wherein said extendable portion and said lower portion of said cup member have generally equal slopes each having generally equal vector components outwardly extending perpendicularly from said longitudinal axis of said cup member when said extendable portion is positioned in said extended position.

12. A megaphone cup, comprising;

a base being generally circular and having upper and lower surfaces, said lower surface of said base being for resting on a surface;

a generally cylindrical tubular cup mount being upwardly extended from said upper surface of said base, said cup mount having a threaded lumen and an upper opening into said lumen of said cup mount;

an annular sealing ring being disposed within said lumen of said cup mount, said sealing ring being positioned towards said upper surface of said base, wherein said sealing ring comprises rubber;

a generally frusto-conical cup member having inner and outer surfaces, top and bottom ends, a longitudinal axis extending between said top and bottom ends, a generally frusto-conical lower portion and a generally frusto-conical extendable portion adjacent said lower portion of said cup, said lower portion and said upper extendable portion of said cup being coaxial with said longitudinal axis of said cup, said cup member being tapered towards said bottom end of said cup member, said inner surface of said cup member defining a cup member hollow interior;

said top end of said cup member having a top opening into said cup member hollow interior;

said bottom end of said cup member having a bottom opening into said cup member hollow interior, said bottom end of said cup member having threads provided on said outer surface of said cup member, said bottom end of said being threadably inserted through said upper opening of said cup mount into said threaded lumen of said cup mount, said sealing ring providing a substantially liquid tight seal between said bottom end of said cup member and said cup mount;

said outer surface of said cup member having an annular sealing gasket being positioned adjacent said threads of said bottom end of said cup member, said sealing gasket being inserted into said lumen of said cup mount, said sealing gasket providing a substantially liquid tight seal between said outer surface of said cup member and said cup mount, wherein said sealing gasket comprises rubber;

said extendable portion of said cup member having a plurality of annular accordion-style pleats, said pleats having centers coaxial with said longitudinal axis of said cup member, said pleats permitting retractable extension of said extendable portion of said cup member between an extended position and a retracted position;

said extendable portion of said cup member having a first frusto-conical configuration when positioned in said extended position and a second frusto-conical configuration when positioned in said retracted position;

said extendable portion and said lower portion of said cup member having generally equal slopes each having generally equal vector components outwardly extending perpendicularly from said longitudinal axis of said cup member when said extendable portion is positioned in said extended position;

said slope of said extendable portion having a vector component outwardly extending perpendicularly from said longitudinal axis of said cup member greater than a corresponding vector component of said slope of said lower portion when said extendable portion is positioned in said retracted position such that said extendable portion of said cup member flares outwards from said longitudinal axis of said cup member a greater degree than said lower portion of said cup member;

said lower portion and said extendable portion of said cup member each having a length defined along said longitudinal axis of said cup member, said lengths of said lower portion and said extendable portion being about equal to one another when said extendable portion is positioned in said extended position, said length of said lower portion being greater than said length of said extendable portion when said extendable portion is positioned in said retracted position;

an arcuate handle having a pair of opposite ends coupled to said outer surface of said cup member in said lower portion of said cup member such that said handle is positioned towards said bottom end of said cup member; and an image being displayed on said outer surface of said cup member.

13. The megaphone cup of claim 11, wherein said slop of said extendable portion has a vector component outwardly extending perpendicularly from said longitudinal axis of said cup member greater than a corresponding vector component of said lower portion when said extendable portion is positioned in said retracted position such that said extendable portion of said cup member flares outwards from said longitudinal axis of said cup member a greater degree than said lower portion of said cup member.

14. The megaphone cup of claim 13, wherein said lower portion and said extendable portion of said cup member each have a length defined along said longitudinal axis of said cup member, wherein said lengths of said lower portion and said extendable portion are about equal to one another when said extendable portion is positioned in said extended position, and wherein said length of said lower portion is greater than said length of said extendable portion when said extendable portion is positioned in said retracted position.

* * * * *